US009380816B2

(12) United States Patent
Jo Longfellow

(10) Patent No.: US 9,380,816 B2
(45) Date of Patent: Jul. 5, 2016

(54) WHEELCHAIR-BOUND COAT

(71) Applicant: Cathy Jo Longfellow, Forest Park, IL (US)

(72) Inventor: Cathy Jo Longfellow, Forest Park, IL (US)

( * ) Notice: Subject to any disclaimer, the term of this patent is extended or adjusted under 35 U.S.C. 154(b) by 331 days.

(21) Appl. No.: 14/152,426

(22) Filed: Jan. 10, 2014

(65) Prior Publication Data

US 2014/0196191 A1 Jul. 17, 2014

Related U.S. Application Data

(60) Provisional application No. 61/753,572, filed on Jan. 17, 2013.

(51) Int. Cl.
*A41D 3/00* (2006.01)

(52) U.S. Cl.
CPC ..... *A41D 3/00* (2013.01); *A41D 2400/44* (2013.01)

(58) Field of Classification Search
CPC ..... A41D 1/00; A41D 1/02; A41D 3/00; A41D 3/005; A41D 3/02; A41D 3/08; A41D 13/00; A41D 15/00; A41D 15/04; A41D 2400/00; A41D 2400/44
USPC ..... 2/69, 69.5, 108, 88, 96, 97, 89, 93–95
See application file for complete search history.

(56) References Cited

U.S. PATENT DOCUMENTS 4,217,663 A * 8/1980 Goldberg ..... A41D 3/00 2/102
4,754,500 A 7/1988 Brucato et al.
4,758,104 A * 7/1988 Fujiwara ..... B41J 1/24 400/144.2
4,764,985 A * 8/1988 Wade ..... A41D 13/1236 2/114
4,771,479 A * 9/1988 Silver ..... A41D 23/00 2/207
4,914,756 A 4/1990 Grassick
4,995,115 A * 2/1991 Ellis ..... A41D 13/129 2/114
5,008,962 A 4/1991 Smith et al.
5,097,535 A 3/1992 Dye et al.
5,168,579 A * 12/1992 Marshall ..... A41D 3/08 2/80
5,437,061 A * 8/1995 Kenner ..... A41D 3/08 2/69
5,535,449 A * 7/1996 Dickey ..... A41B 13/06 2/69
5,564,123 A * 10/1996 Grassick ..... A41D 13/1245 2/114
5,611,083 A 3/1997 Arnold
5,727,255 A 3/1998 Minks
5,815,833 A * 10/1998 Kuo ..... A41D 15/04 2/69.5
6,061,831 A * 5/2000 Rudolph ..... A41D 15/04 2/69
6,272,683 B1 * 8/2001 Symms ..... A41B 13/06 2/69.5

(Continued)

*Primary Examiner* — Gloria Hale
(74) *Attorney, Agent, or Firm* — Buckingham, Doolittle & Burroughs, LLC

(57) ABSTRACT

A garment is disclosed that enables caregivers to safely and comfortably outfit wheelchair-bound people when going outside. The garment comprises a garment body configured to extend around a front of a user and to wrap around a seatback of a user's wheelchair and be secured together, an opening at the top of the garment body for a user's neck, and a pair of sleeves for receiving the arms of the user, and wherein at least one of the opposing sides of the garment body comprises fastening components which are removably secured together to secure the back of the garment body to the front of the garment body. The opening at the top of the garment body comprises an approximately V-shaped notch to accommodate a trachea tube, and a hood for engaging over the head of the user and leaving the face open.

19 Claims, 6 Drawing Sheets

(56) References Cited

U.S. PATENT DOCUMENTS

| | | | | |
|---|---|---|---|---|
| 6,401,248 | B1 * | 6/2002 | Christensen | A41D 3/08 2/69 |
| 6,408,439 | B1 * | 6/2002 | Garforth-Crippen | A41B 13/106 2/80 |
| 8,161,573 | B1 | 4/2012 | Burns-Cox | |
| 2003/0159192 | A1 * | 8/2003 | La Scala | A41D 13/1236 2/69 |
| 2009/0165206 | A1 * | 7/2009 | Davis | A47D 15/006 5/494 |
| 2010/0064412 | A1 * | 3/2010 | Slutzky | A41D 3/08 2/84 |
| 2010/0170039 | A1 * | 7/2010 | Davis | A47D 15/006 5/494 |
| 2014/0132055 | A1 * | 5/2014 | Jenkins | B60N 2/265 297/465 |
| 2014/0196191 | A1 * | 7/2014 | Jo Longfellow | A41D 3/00 2/84 |

* cited by examiner

WHEELCHAIR-BOUND COAT

CROSS-REFERENCE

This application claims priority from Provisional Patent Application Ser. No. 61/753,572 filed Jan. 17, 2013.

BACKGROUND

The stuffing in traditional winter coats can compromise a wheelchair-bound user's back and spine because the stuffing (or linings) can bunch up and become highly uncomfortable for a seated user. Further, this can become a safety, or health risk for users with bone or muscle issues. Some caregivers may drape a blanket over the wheelchair-bound user's body instead, but blankets can get caught in the wheelchair's wheels and are not form fitting to the wearer. Additionally, in general wheelchair-bound users may not have very many matching, put-together clothing options, which can be frustrating and inconvenient. An effective solution is necessary.

The present invention provides a comfortable and safe garment for wheelchair-bound users, and wraps around the back of a wheelchair to prevent the garment's stuffing or linings from interfering with a user's posture. This garment also creates a more stylish and put-together look for wheelchair-bound users, and prevents the need to cover wheelchair-bound users in blankets, which can get stuck in the chair's wheels. Further, the garment reduces the amount of time it takes caregivers to dress wheelchair-bound users.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a garment that enables caregivers to safely and comfortably outfit wheelchair-bound users when going outside. The garment comprises a garment body configured to extend around a front of a user and to wrap around a seatback of a user's wheelchair and be secured together, an opening at the top of the garment body for a user's neck, and a pair of sleeves for receiving the arms of the user, and wherein at least one of the opposing sides of the garment body comprises fastening components which are removably secured together to secure the back of the garment body to the front of the garment body. The opening at the top of the garment body comprises an approximately V-shaped notch to accommodate a trachea tube or other medically necessary equipment. The garment body also comprises a hood removably secured to the top of the garment body for engaging over the head of the user, and leaving the face of the user exposed.

In a preferred embodiment, the opposing sides of the garment body are typically shorter in length than the front and the back of the garment body and curve upward to prevent interference with the wheels of the user's wheelchair. Further, the sleeves can comprise a mitten or glove secured to an end of each sleeve. Additionally, the garment can comprise at least one scarf removably secured to the exterior of the garment body, and a fastening component positioned on a shoulder area of the garment body for securing an accessory, such as a scarf, a bib, a clothing protector, etc.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
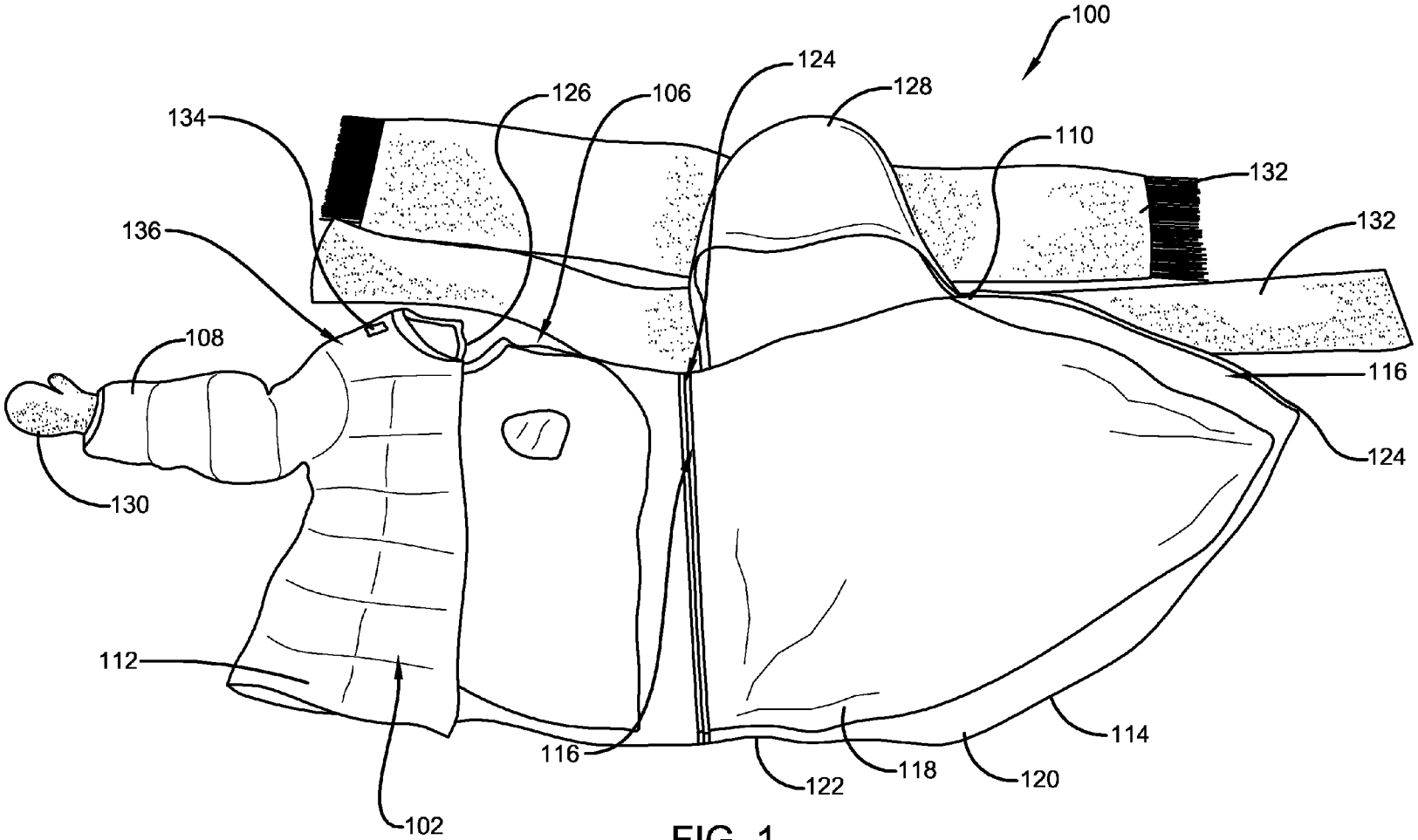
FIG. 1 illustrates a front perspective view of the garment in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention provides a comfortable and safe coat for wheelchair-bound users, and wraps around the back of a wheelchair to prevent the coat's stuffing from interfering with a user's posture. This garment also creates a more stylish and put-together look for wheelchair-bound users, and prevents the need to cover wheelchair-bound users in blankets, which can get stuck in the chair's wheels. Further, the garment reduces the amount of time it takes caregivers to dress wheelchair-bound users.

The disclosed garment comprises a garment body configured to extend around a front of a user and to wrap around a seatback of a user's wheelchair and be secured together, an opening at the top of the garment body for a user's neck, and a pair of sleeves for receiving the arms of the user, and wherein at least one of the opposing sides of the garment body comprises fastening components which are removably secured together to secure the back of the garment body to the front of the garment body. The opening at the top of the garment body comprises an approximately V-shaped notch to accommodate a trachea tube, and a hood for engaging over the head of the user and leaving the face exposed. Additionally, the garment can comprise at least one scarf removably secured to the exterior of the garment body.

Figure 2:
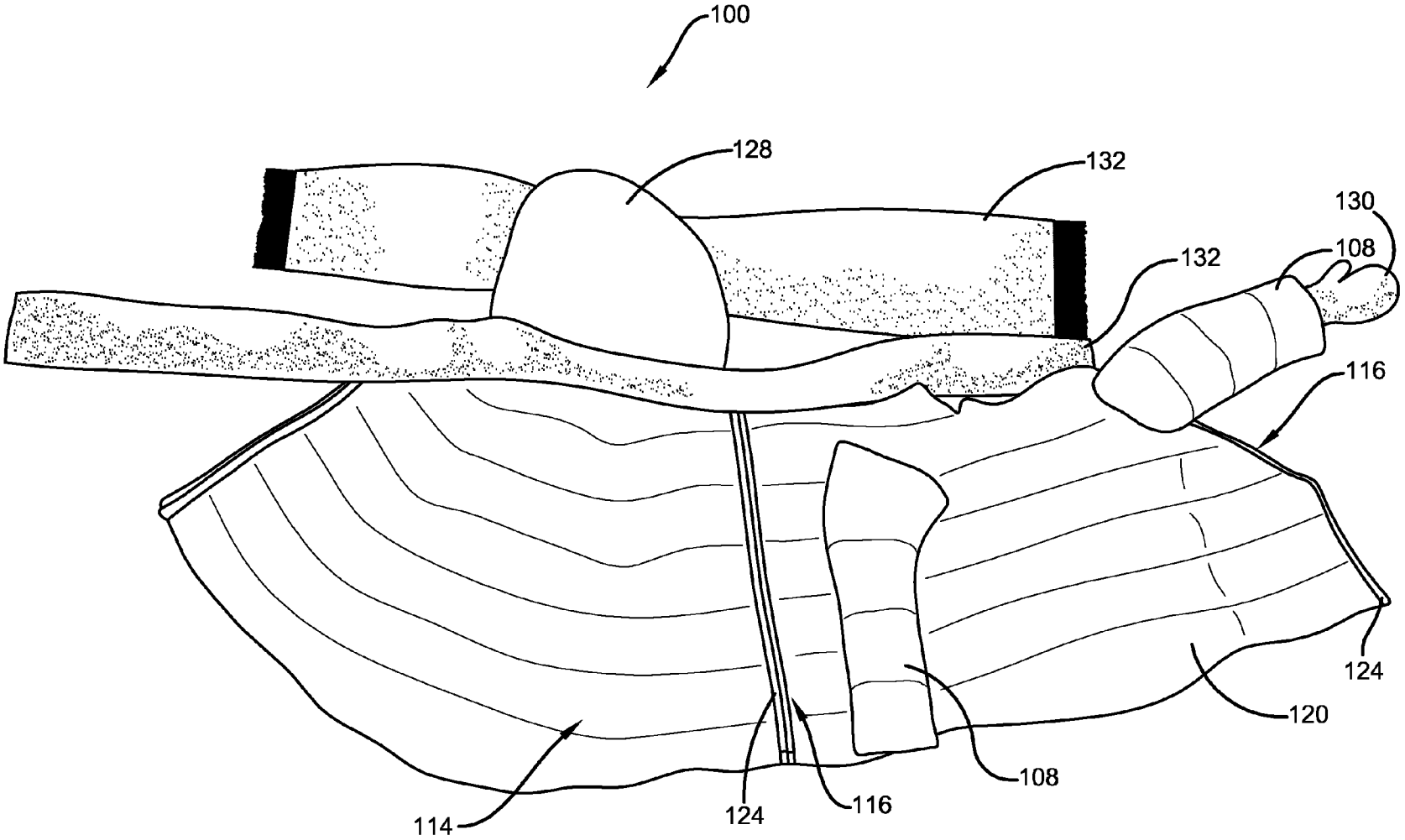
FIG. 2 illustrates a rear perspective view of the garment in accordance with the disclosed architecture.

Referring initially to the drawings, FIGS. 1-2 illustrate the garment 100 that enables caregivers to safely and comfortably outfit wheelchair-bound users when going outside. The garment 100 comprises a garment body 102 configured to extend around a front of a user 300 and to wrap around a seatback 104 of a user's wheelchair 302 and be secured together, an opening 106 at the top of the garment body 102 for a user's neck, and a pair of sleeves 108 for receiving the arms of the user 300, and wherein the opposing sides 116 of the garment body 102 each comprise fastening components 124 which are removably secured together to secure the back 114 of the garment body 102 to the front 112 of the garment body 102 (as shown in FIG. 1). Furthermore, the garment 100 is typically a weather-resistant coat, or any other suitable protective outerwear garment as is known in the art, such as a windbreaker, a sweater, a sweatshirt, a jacket, etc.

The garment body 102 comprises a top 110, a front 112, a back 114, opposing sides 116, an interior 118, and an exterior 120. Typically, the garment body 102 can be any suitable shape as is known in the art without affecting the overall concept of the invention. The garment body 102 would generally be constructed of material, such as nylon, Gortex®, polyvinyl chloride (PVC), acrylonitrile butadiene styrene (ABS), polycarbonate (PC), down, cotton, jersey knit, etc., though any other suitable material may be used to manufacture the garment body 102 as is known in the art without affecting the overall concept of the invention, as long as the material is generally weather-resistant and machine or hand-washable.

The garment body 102 can also comprise a variety of colors and designs to suit user and manufacturing preference. While the shape and size of the garment body 102 may vary greatly depending on the wants and needs of a user, as well as the size and weight of the user, the garment body 102 is typically of a length sufficient to extend down and substantially cover a torso of the user 300. The garment body 102 can be any suitable size as is known in the art and can be made to fit children as well as adults.

Figure 3:
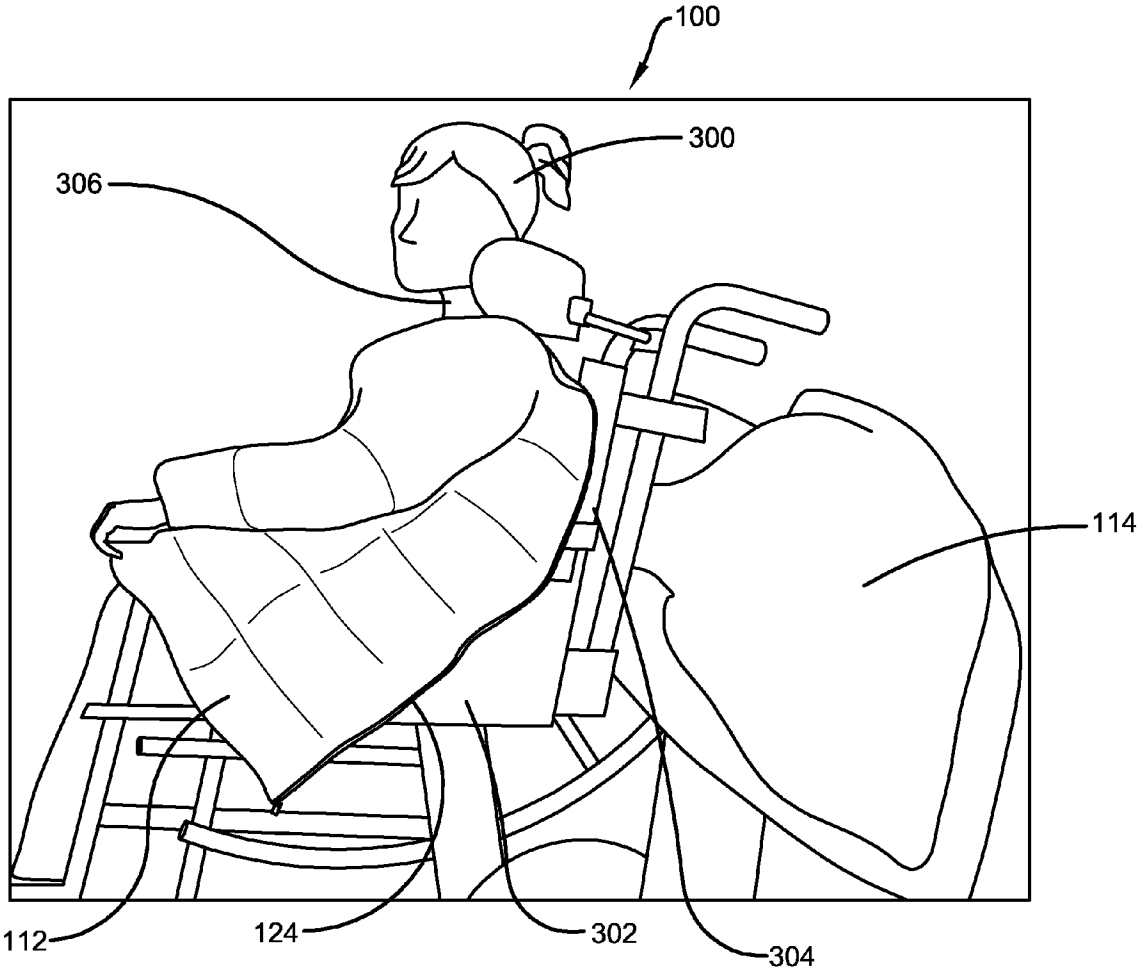
FIG. 3 illustrates a side perspective view of the front of the garment in use in accordance with the disclosed architecture.

The garment body 102 is configured to extend around a front of a user (300 as shown in FIG. 3) and to wrap around a seatback of a user's wheelchair (302 as shown in FIG. 3) and be secured together. The garment body 102 is configured to be separated at the opposing sides 116 and the opposing sides 116 each comprise fastening components 124 that are removably secured together, however only one of the opposing sides 116 needs to comprise fastening components 124. The garment 100 will still function as long as one of the opposing sides 116 comprises fastening components 124, but both of the opposing sides 116 can comprise fastening components 124, depending on the wants and needs of a user. The fastening components 124 can be any suitable securing means known in the art such as zippers, locking zippers, hook and loop fasteners, buttons, snaps, etc. When separated, the front 112 of the garment body 102 extends around a front of the user and the back 114 of the garment body 102 wraps around the seatback of the user's wheelchair. Once in position, the fastening components 124 at the opposing sides 116 can be secured together, securing the garment body 102 to the user and around the seatback of the wheelchair. Further, the back 114 of the garment body 102 is gathered with elastic or other suitable stretchy material such that the garment body 102 will fit tightly (or snugly) around the seatback of the user's wheelchair 302 to prevent cold air from getting in.

Additionally, the opposing sides 116 of the garment body 102 are typically shorter in length than the front 112 and the back 114 of the garment body 102. Specifically, the opposing sides 116 curve upward to prevent interference with the wheels of the user's wheelchair 302, so as not get caught up in the wheels. However the opposing sides 116 do not have to be shorter in length than the front 112 and the back 114 of the garment body 102, and the garment 100 can function even if the opposing sides 116 are the same length or longer in length than the front 112 and the back 114 of the garment body 102. The length of the opposing sides 116 can be determined by the wants and needs of a user and/or at the point of manufacture.

The garment body 102 further comprises an opening 106 at the top 110 of the garment body 102 for a user's neck. The opening 106 is typically rounded in shape to allow for the user's neck, but can be any suitable shape as is known in the art. Further, the opening 106 at the top 110 of the garment body 102 comprises an approximately V-shaped notch 126 to accommodate (or allow access to) a trachea tube or other medically necessary equipment. This V-shaped notch 126 can vary in depth to accommodate different sized trachea tubes or other medically necessary equipment. Additionally, the garment body 102 can comprise a hood 128 removably secured to the top 110 of the garment body 102 for engaging over the head of the user 300, and leaving the face of the user 300 exposed. The hood 128 can be any suitable size as is known in the art, as long as it substantially covers the head of the user but leaves the face exposed. Typically, the hood 128 would be larger in size than prior art hoods, to allow for the hood to come up over the back of the wheelchair and still fit around the head of the user. The hood 128 would typically be made of the same material as the garment body 102, but does not have to be and can be made of different material as long as the material is generally weather-resistant and machine or hand-washable. The hood 128 would be removably secured to the top 110 of the garment body 102 via any suitable securing means as is known in the art, such as a zipper, a hook and loop fastener, a snap, etc.

Additionally, the garment body 102 comprises a pair of sleeves 108 with a continuous opening therein for receiving the arms of the user 300. The sleeves 108 are secured to the opposing sides 116 of the garment body 102 via any suitable securing means as is known in the art, such as sewing, gluing, fasteners, etc. Typically, the sleeves 108 are made to be long enough to extend down past the hands of the user to cover the user's hands (and can have a thumb-hole to hold the sleeve 108 in place), but the sleeves 108 can be any suitable length known in the art as long as the sleeves 108 substantially cover the arms of the user. Further, the sleeves 108 can comprise a mitten or glove 130 secured to an end of each sleeve 108. The mittens or gloves 130 can be secured via any suitable securing means as is known in the art such as sewing, gluing, fasteners, snaps, buttons, hook and loop fasteners, etc. The mittens or gloves 130 can be recessed or hidden in the ends of the sleeves 108 when not in use and then pulled out when needed.

The garment 100 further comprises at least one scarf 132 removably secured to the hood 128, and/or exterior 120 of the garment body 102. Any suitable number of scarves 132 can be secured to the hood 128 and/or exterior 120 of the garment body 102 as is known in the art, depending on the wants and needs of the user. The scarves 132 are secured to the garment body 102 via any suitable securing means as is known in the art, such as sewing, gluing, fasteners, etc. Additionally, the garment 100 can comprise a fastening component 134 positioned on a shoulder area 136 (or any other suitable position) of the garment body 102 for securing an accessory. The fastening component 134 can be any suitable fastening component as is known in the art, such as a snap, a button, a hook and loop fastener, etc. The accessory can be any suitable accessory as is known in the art, such as a scarf, a bib, a clothing protector, etc. Any suitable number of fastening components 134 can be secured to the garment body 102 as is known in the art, depending on the wants and needs of a user. The scarves 132 and other accessories can also be color-coordinated to match the garment 100.

Figure 6:
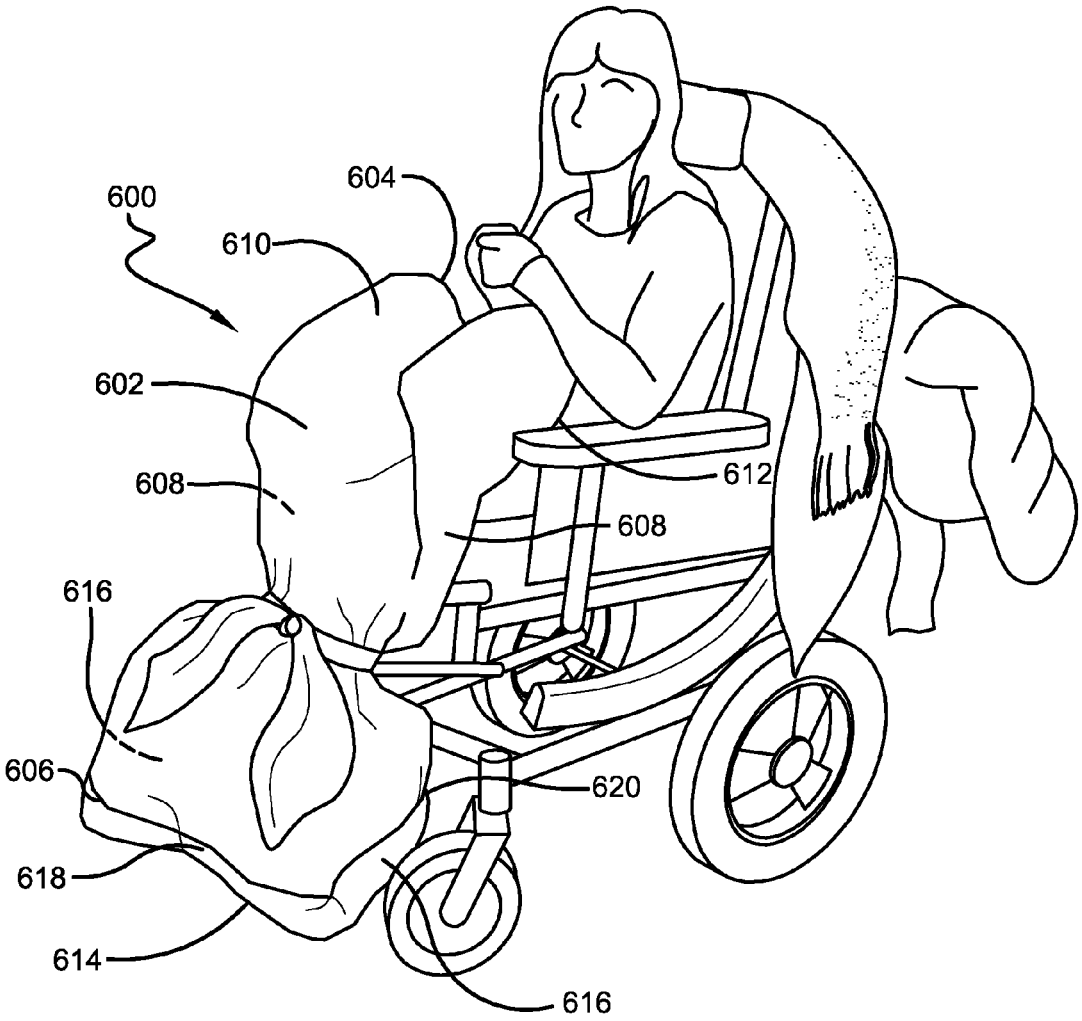
FIG. 6 illustrates a perspective view of the garment in use with the leg wrap in accordance with the disclosed architecture.

Additionally, the garment 100 can comprise a leg wrap 600 that fits around the legs of a user. The leg wrap 600 comprises a first piece of material 602 comprising a first end portion 604, a second end portion 606, opposing sides 608, a front surface 610, and a back surface 612. A second piece of material 614 is then secured to the back surface 612 of the first piece of material 602 to create a pocket for receiving the feet of the user. The second piece of material 614 is secured to the first piece of material 602 via any suitable securing means as is known in the art, such as sewing, hook and loop fasteners, gluing, etc. Specifically, the opposing sides 616 and the first end 618 are secured to the back surface 612 of the first piece of material 602, leaving the second end 620 open which creates a pocket and allows the leg wrap 600 to be placed over the user's legs with the user's feet (and shoes), and metal stirrups of the wheelchair placed inside the pocket for warmth (as shown in FIG. 6). The leg wrap 600 can be secured to the garment body 102 via any suitable securing means as is known in the art, such as sewing, gluing, fasteners, hook and loop fasteners, etc. Typically, the leg wrap 600 would be secured to the bottom 122 of the garment body 102, but can be secured to any suitable position on the garment body 102. Further, the leg wrap 600 does not have to be secured to the garment body 102 and can function as a separate piece from the garment body 102, and can be worn separately or together with the garment body 102.

Furthermore, the garment 100 can comprise a loop or other tag such that a user or caregiver can hang the garment 100 up via the loop or tag when not being worn. Also, the garment 100 can be folded up and stored in a storage bag (not shown) or other holder when not in use, so as to be easy to travel with and transport. Other accessories can be used with the garment 100 and modified for a wheelchair-bound user, such as an umbrella, a beverage holder, sunglasses, boots, telescoping coat hook attachment, travel bag, compression clothing, etc.

Figure 4:
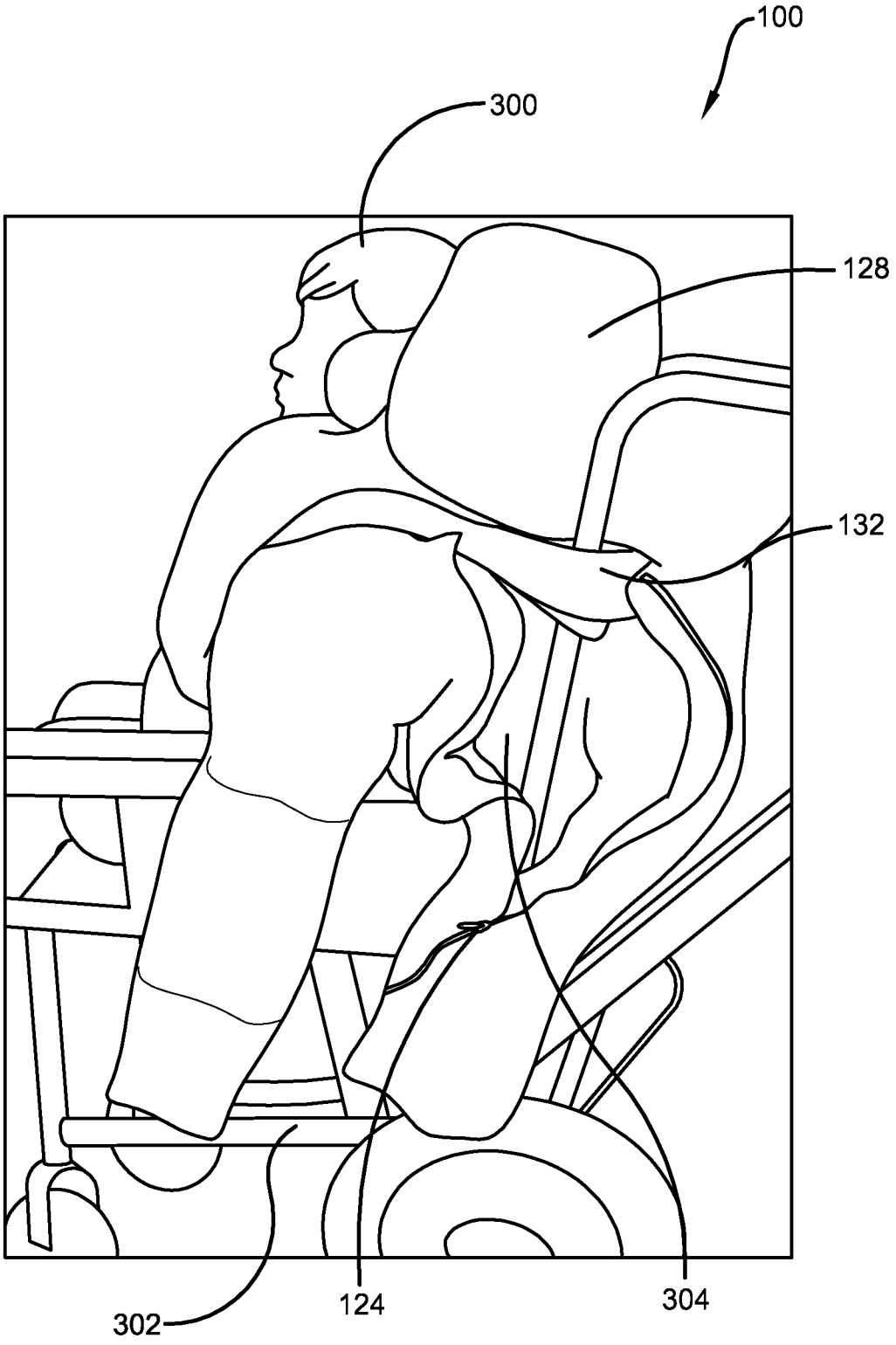
FIG. 4 illustrates a side perspective view of the garment in use in accordance with the disclosed architecture.
Figure 5:
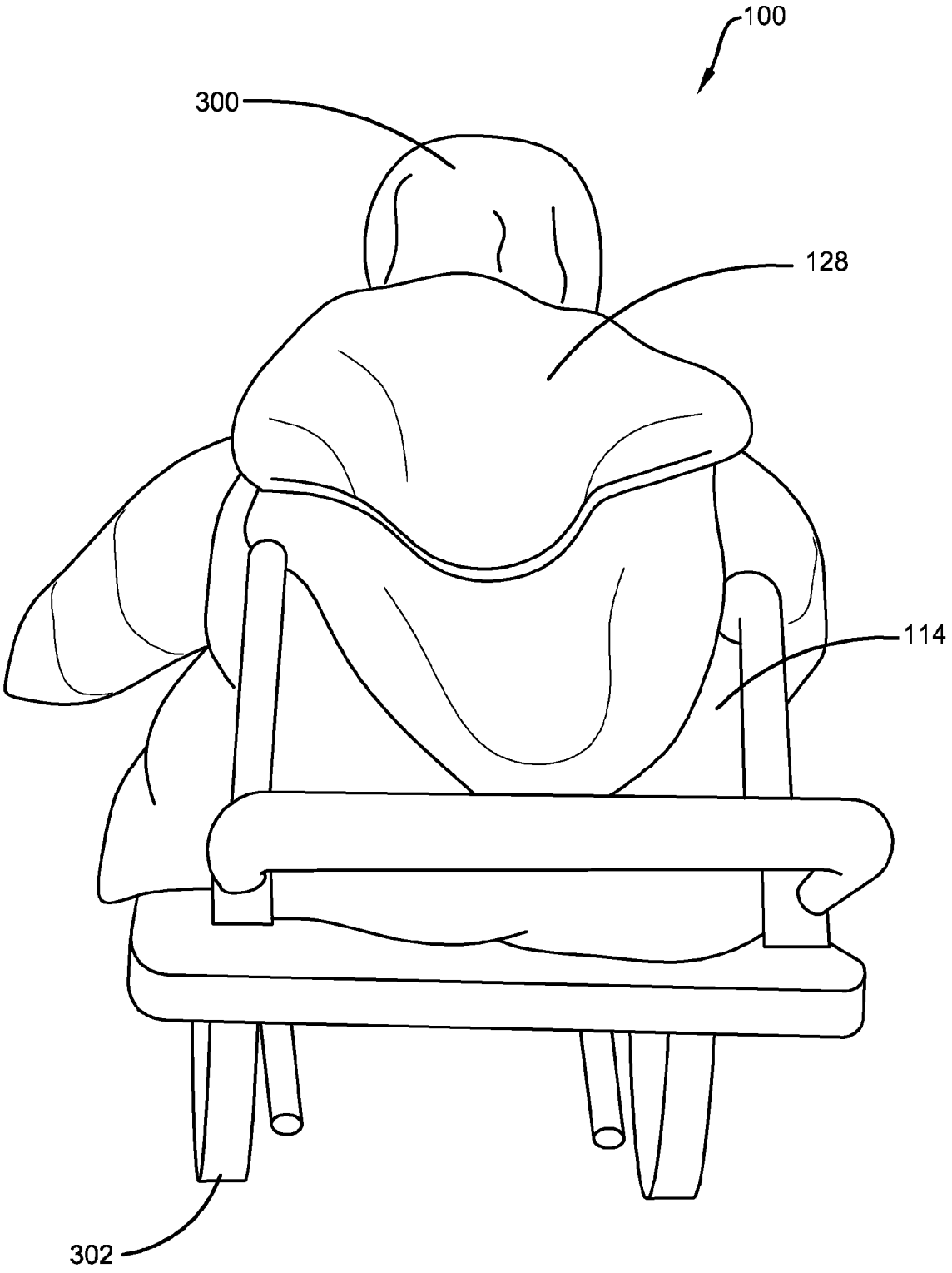
FIG. 5 illustrates a rear perspective view of the garment in use in accordance with the disclosed architecture.

FIGS. 3-5 illustrates the garment 100 in use. As stated supra, the garment 100 comprises a garment body 102 configured to extend around a front of a user 300 and to wrap around a seatback 304 of a user's wheelchair 302 and be secured together, an opening 106 at the top 110 of the garment body 102 for a user's neck 306, and a pair of sleeves 108 for receiving the arms of the user, and wherein at least one of the opposing sides 116 of the garment body 102 comprises fastening components 124 which are removably secured together to secure the back 114 of the garment body 102 to the front 112 of the garment body 102. The opening 106 at the top 110 of the garment body 102 comprises an approximately V-shaped notch 126 to accommodate a trachea tube, and a hood 128 for engaging over the head 306 of the user and leaving the face of the user exposed. Additionally, the garment 100 can comprise at least one scarf 132 removably secured to the exterior 120 of the garment body 102.

In operation, a user 300 chooses the color and/or design of the garment 100 that meets their needs and wants. The user 300 or caregiver (not shown) then unzips at least one of the opposing sides 116 via the zipper or other fastening component 124. The user 300 then inserts their arms into the sleeves 108 (as shown in FIG. 3) and the caregiver wraps the back 114 of the garment body 102 around the seatback 304 of the user's wheelchair 302 and secures the side 116 via zipping up the zipper or other fastening component 124 (as shown in FIG. 4). Once secure, the user 300 can pull down the mittens or gloves 130 from the sleeves 108 and put them on their hands. The caregiver can secure the hood 128 to the opening 106 of the garment body 102 and can pull the hood 128 up over the head 306 of the user 300. The caregiver can then secure scarves 132 to the exterior of the garment body 102 and can wrap these scarves 132 around the user 300 for warmth. The caregiver can then attach additional accessories such as a scarf, a bib, a clothing protector, etc. to the shoulder area 136 or other area on the garment body 102 for use. Accordingly, the garment 100 enables caregivers to safely and comfortably outfit wheelchair-bound users when going outside (as shown in FIG. 5).

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A garment for enclosing a portion of a wheelchair-bound user comprising:

a garment body configured to extend around a front of a user and to wrap around a seatback of a user's wheelchair and be secured together, and to extend down and substantially cover a torso of the user, the garment body comprising a top, a front, a back, opposing sides, an interior, and an exterior;

an opening at the top of the garment body for a user's neck; and a pair of sleeves with a continuous opening therein for receiving arms of the user, the pair of sleeves being secured to the opposing sides of the garment body; and wherein at least one of the opposing sides of the garment body comprises fastening components which are removably secured together to secure the back of the garment body to the front of the garment body; and wherein when the fastening components are released and the at least one opposing side is opened, the back of the garment body can be separated from the front of the garment body; and wherein the back of the garment body is gathered with elastic and is configured of a size such that the garment body will fit tightly around the seatback of the user's wheelchair.

2. The garment of claim 1, wherein the pair of sleeves comprises a mitten attached to an end of each sleeve.

3. The garment of claim 1, wherein the opening at the top of the garment body comprises an approximately V-shaped notch to accommodate a trachea tube.

4. The garment of claim 3, further comprising a hood removably secured to the top of the garment body for engaging over the head of the user, leaving a face of a user exposed.

5. The garment of claim 4, further comprising at least one scarf removably secured to the garment.

6. The garment of claim 1, wherein the pair of sleeves are configured to extend down past hands of the user.

7. The garment of claim 1, wherein the opposing sides of the garment body are configured to curve upward at a length to prevent interference with wheels of the user's wheelchair.

8. The garment of claim 1, wherein the fastening components of the at least one opposing side comprise at least one of a zipper, hook and loop fasteners, snaps, or buckles.

9. The garment of claim 1, wherein the garment is comprised of a weather-resistant material.

10. The garment of claim 1, further comprising a fastening component on a shoulder area of the garment body for securing an accessory.

11. The garment of claim 10, wherein the fastening component is at least one of a snap, a button, or a hook and loop fastener.

12. The garment of claim 10, wherein the accessory is at least one of a scarf, a bib, or a clothing protector.

13. A coat for enclosing a portion of a wheelchair-bound person comprising:

a garment body comprised of weather-resistant material and configured to extend around a front of a user and to wrap around a seatback of a user's wheelchair and be secured together, and to extend down and substantially cover a torso of the user, the garment body comprising a top, a front, a back, opposing sides, an interior, and an exterior;

an opening at the top of the garment body for a user's neck;

a hood removably secured to the top of the garment body for engaging over the head of the user, leaving a face of the user exposed; and a pair of sleeves with a continuous opening therein for receiving arms of the user, the pair of sleeves being secured to the opposing sides of the garment body and configured to extend down past hands of the user; and wherein at least one of the opposing sides of the garment body comprises a zipper opening which is removably secured together via the zipper to secure the back of the garment body to the front of the garment body; and wherein when the zipper is released and the at least one opposing side is opened, the back of the garment body can be separated from the front of the garment body; and wherein the opposing sides of the garment body are configured to curve upward at a length to prevent interference with wheels of the user's wheelchair; and wherein the back of the garment body is gathered with elastic and is configured of a size such that the garment body will fit tightly around the seatback of the user's wheelchair.

14. The coat of claim 13, wherein the pair of sleeves comprises a mitten attached to an end of each sleeve.

15. The coat of claim 13, further comprising at least one scarf removably secured to the exterior of the garment.

16. The coat of claim 13, wherein the opening at the top of the garment body comprises an approximately V-shaped notch to accommodate a trachea tube.

17. The coat of claim 13, further comprising a leg wrap secured to the garment body, the leg wrap comprising: a first piece of material comprising a front surface and a back surface; and a second piece of material secured to the back surface of the first piece of material to create a pocket for receiving feet of the user.

18. A protective outerwear garment for enclosing a portion of a wheelchair-bound person comprising:

a garment body configured to extend around a front of a user and to wrap around a seatback of a user's wheelchair and be secured together, and to extend down and substantially cover a torso of the user, the garment body comprising a top, a front, a back, opposing sides, an interior, and an exterior;

a hood removably secured to the top of the garment body for engaging over the head of the user, leaving a face of the user exposed; and a pair of sleeves with a continuous opening therein for receiving arms of the user, the pair of sleeves being secured to the opposing sides of the garment body and configured to extend down past hands of the user and comprise a mitten attached to an end of each sleeve; and wherein at least one of the opposing sides of the garment body comprises a hook and loop fastener opening which is removably secured together via the hook and loop fastener to secure the back of the garment body to the front of the garment body; and wherein when the hook and loop fastener is released and the at least one opposing side is opened, the back of the garment body can be separated from the front of the garment body; and a leg wrap secured to the garment body, the leg wrap comprising a first piece of material comprising a front surface and a back surface; and a second piece of material secured to the back surface of the first piece of material to create a pocket for receiving feet of the user; and wherein the back of the garment body is gathered with elastic and is configured of a size such that the garment body will fit tightly around the seatback of the user's wheelchair.

19. The protective outerwear garment of claim 18, further comprising at least one scarf removably secured to the exterior of the garment.

* * * * *